US005864897A

United States Patent [19]

Ross

[11] Patent Number: 5,864,897

[45] Date of Patent: Feb. 2, 1999

[54] DEVICE FOR ISOLATING PIPING ASSOCIATED WITH A SWIMMING POOL

[76] Inventor: Terence D. Ross, 383 Duncan Ln., Andersonville, Tenn. 37705

[21] Appl. No.: 785,848

[22] Filed: Jan. 21, 1997

[51] Int. Cl.[6] ..... E04H 4/00

[52] U.S. Cl. ..... 4/507; 4/496

[58] Field of Search ..... 4/567, 496, 488, 4/490, 506, 509, 541.1, 541.3

[56] References Cited

U.S. PATENT DOCUMENTS

| | | | |
|---|---|---|---|
| 3,378,858 | 4/1968 | Jacuzzi | 4/507 |
| 4,275,474 | 6/1981 | Woodard | 15/1.7 |
| 4,637,086 | 1/1987 | Goode | 15/1.7 |
| 4,658,449 | 4/1987 | Martin | 4/496 |
| 4,718,129 | 1/1988 | Miller | 4/490 |
| 4,776,053 | 10/1988 | Kiraly | 15/1.7 |
| 4,832,838 | 5/1989 | Stone | 210/169 |
| 5,268,096 | 12/1993 | Robol | 4/507 |
| 5,311,631 | 5/1994 | Smith | 15/1.7 |
| 5,317,776 | 6/1994 | Demoura | 15/1.7 |
| 5,396,677 | 3/1995 | Rissik et al. | 15/1.7 |
| 5,398,361 | 3/1995 | Cason | 15/1.7 |
| 5,465,443 | 11/1995 | Rice et al. | 15/246 |

*Primary Examiner*—David J. Walczak
*Attorney, Agent, or Firm*—Pitts & Brittian, P.C.

[57] ABSTRACT

A device for isolating piping associated with a swimming pool for isolating a piping system associated with a swimming pool in order to reduce the amount of chemicals required to treat the piping system, and further to prevent mixture of chemicals within the pool with the treatment chemicals. The isolating device includes an adaptor head having an outlet configured to encircle a conventional swimming pool drain and an inlet configured to receive the end of a conventional vacuum hose. The adaptor head defines a substantially cylindrical configuration having a diameter at least as large as the particular drain with which the isolating device is being used. A plurality of screw bosses is provided on the interior of the adaptor head proximate the outlet to cooperate with the threaded openings provided in the drain for securing the drain grate. The adaptor head includes a cylindrical wall and a cover plate, the cover plate being removably mounted to the cylindrical. The inlet is carried by the cover plate and is configured to be closely received within one end of a conventional vacuum hose. The cover plate carries a relief valve for pressure equalization within the piping system, and especially within the isolating device. An attachment member is provided for the attachment of an elongated handle member. The attachment member is similar to conventional attachment members carried by conventional vacuum heads. The handle is attached to the adaptor head for manipulating the adaptor head to a position over the drain. When the isolating device is not secured to the drain as described above, the handle may be used to apply pressure to the adaptor head to maintain its position.

10 Claims, 3 Drawing Sheets

DEVICE FOR ISOLATING PIPING ASSOCIATED WITH A SWIMMING POOL

TECHNICAL FIELD

This invention relates to the field of devices for cleaning swimming pools. More specifically, the present invention relates to a device for isolating the piping system used to convey water between a swimming pool and a filtering system such that the piping system may be chemically treated without treating the water in the swimming pool.

BACKGROUND ART

In the field of swimming pools, it is well known that the piping system associated with the swimming pool may become contaminated or infected with bacteria which is difficult to treat using conventional devices and methods. Conventionally, in order to treat the piping system, the entire pool must be treated, thereby allowing treated water to flow through the piping system. However, due to the dissipation of the treatment into the volume within the pool, ineffective amounts of chemicals may be introduced into the piping system. Further, it is well known that contaminated piping systems often cause the water within the pool to become contaminated. It is also well known that chemicals necessary to treat the piping system may not be compatible with chemicals in the pool, such as chlorine, and addition of those chemicals may cause the water to become discolored or create other adverse effects. However, without being able to effectively treat the piping system, it is often difficult to treat the swimming pool. As a result, chemicals must be put into the swimming pool at a volume much greater than would be required to treat the piping system alone.

Therefore, it is desirable to isolate the piping system associated with a swimming pool such that it may be chemically treated without treating the water within the swimming pool itself. Many devices have been produced to assist in the cleaning of a swimming pool. Typical of the art are those devices disclosed in the following U.S. Patents:

| U.S. Pat. No. | Inventor(s) | Issue Date |
|---|---|---|
| 4,275,474 | R. C. Woodard | June 30, 1981 |
| 4,637,086 | J. Goode | Jan. 20, 1987 |
| 4,718,129 | R. E. Miller | Jan. 12, 1988 |
| 4,776,053 | J. G. Kiraly | Oct. 11, 1988 |
| 4,832,838 | D. K. Stone | May 23, 1989 |
| 5,311,631 | C. L. Smith, Jr. | May 17, 1994 |
| 5,317,776 | R. J. DeMoura | June 7, 1994 |
| 5,396,677 | G. V. Rissik, et al. | Mar. 14, 1995 |
| 5,398,361 | K. N. Cason | Mar. 21, 1995 |
| 5,465,443 | C. A. Rice, et al. | Nov. 14, 1995 |

Of these devices, that disclosed by Miller ('129) is a container configured to be used with the skimmer of the circulation system. An outlet is defined on the bottom of the container, with an inlet on the top. A vacuum hose is securable to the top of the container. However, the Miller device does not provide a means for isolating the piping system.

The device disclosed by Stone ('838) is provided for creating a turbulence in a swimming pool in order to move larger debris to the top of the swimming pool to then be removed through the skimmer, with smaller debris being forced through a drain in the floor of the pool. As in the Miller device, there is no provision for the isolation of the piping system from the volume of water in the swimming pool.

DeMoura ('776) discloses an electrically powered vacuum apparatus for use in a swimming pool, exclusive of the circulatory system associated with the swimming pool. Although the DeMoura device incorporates a vacuum head, and especially because of its exclusive nature with respect to the circulatory system, the DeMoura device cannot be used to isolate the piping system from the swimming pool.

The remainder of the referenced patents disclose various devices which are vacuum heads for use with conventional swimming pool cleaning systems. As with the previous devices, such do not disclose a means for isolating the swimming pool piping. Nor does any of the cited prior art indicate a need to isolate the piping.

Therefore, it is an object of this invention to provide a means for isolating the piping system associated with a swimming pool such that the water within the piping system may be chemically treated, substantially exclusive of the volume of water within the swimming pool.

It is another object of the present invention to provide a means for isolating the swimming pool piping whereby chemical treatment of the piping may be accomplished using a greatly reduced volume of chemicals, as a result of not being required to add chemicals into the entire volume of water within the swimming pool and piping system, thereby reducing the expense of cleaning the piping system.

Still another object of the present invention is to provide such a device which may be adapted to be used with any selected circulatory system associated with a liquid retention reservoir.

DISCLOSURE OF THE INVENTION

Other objects and advantages will be accomplished by the present invention which serves to assist in the isolation of a piping system associated with a swimming pool or other liquid receptacle in order to reduce the amount of chemicals required to treat the piping system and thus reduce the cost and time associated therewith. The present invention further serves to allow treatment of the piping system while preventing mixture of chemicals within the pool with the treatment chemicals in or to avoid adverse effects caused by the treatment. The isolating device is comprised generally of an adaptor head having an outlet configured to encircle a conventional swimming pool drain and an inlet configured to receive the end of a conventional vacuum hose. The adaptor head defines a substantially cylindrical configuration having a diameter at least as large as the particular drain with which the isolating device is being used. A plurality of screw bosses is provided on the interior of the adaptor head proximate the outlet to cooperate with the threaded openings provided in the drain for securing the drain grate.

The adaptor head includes a cylindrical wall and a cover plate, the cover plate being removably mounted to the cylindrical. The inlet is carried by the cover plate and is configured to be closely received within one end of a conventional vacuum hose. The cover plate carries a relief valve for pressure equalization within the piping system, and especially within the isolating device.

An attachment member is provided for the attachment of an elongated handle member. The attachment member is similar to conventional attachment members carried by conventional vacuum heads. The handle is attached to the adaptor head for manipulating the adaptor head to a position over the drain. When the isolating device is not secured to the drain as described above, the handle may be used to apply pressure to the adaptor head to maintain its position.

In order to use the isolating device, each drain and skimmer is placed in fluid communication with a return such that water flows directly from a return to a drain or skimmer. In those situations where there are more returns than drains and skimmers, extra drains are either plugged or tied into other returns. In a contrary situation, the extra drains and/or skimmers are either plugged or tied together. Thus, in any situation, water is prevented from flowing into or out of the pool and out of or into the piping system.

BRIEF DESCRIPTION OF THE DRAWINGS

The above mentioned features of the invention will become more clearly understood from the following detailed description of the invention read together with the drawings in which.

BEST MODE FOR CARRYING OUT THE INVENTION

A device for isolating piping associated with a swimming pool incorporating various features of the present invention is illustrated generally at 10 in the figures. The device for isolating piping associated with a swimming pool, or isolating device 10, is designed for assisting in the isolation of a piping system 42 associated with a swimming pool 40 or other liquid receptacle. By isolating the swimming pool piping system 42, the isolating device 10 of the present invention allows for the reduction of chemicals required to treat the piping system 42, thereby reducing the costs associated therewith, and also reducing the time required to complete such treatment in order to return the pool 40 to a usable condition. The isolating device 10 further serves to allow treatment of the piping system 42 while preventing mixture of chemicals within the pool 40 with the treatment chemicals in or to avoid adverse effects caused by the treatment. The isolating device 42 is also useful during the winterization process for a swimming pool 40.

Figure 1:
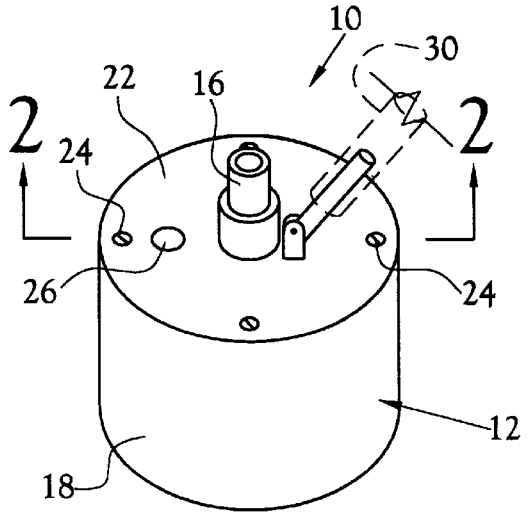
FIG. 1 is a perspective view of the device for isolating piping associated with a swimming pool constructed in accordance with several features of the present invention.
Figure 2:
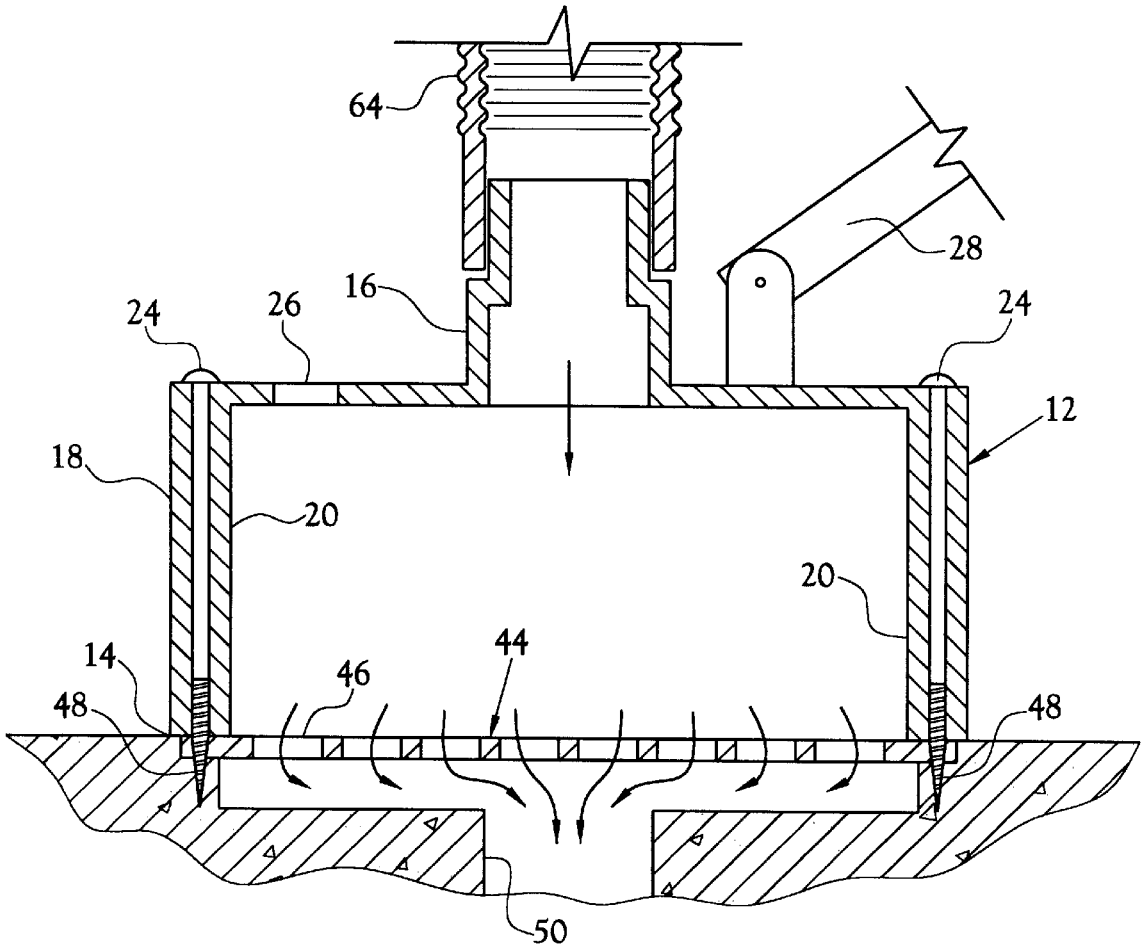
FIG. 2 illustrates an elevation view, in section, of the device for isolating piping associated with a swimming pool taken at 2—2 of FIG. 1, illustrating the device being disposed above a swimming pool drain and having a vacuum hose and handle secured thereto.

As illustrated in FIGS. 1 and 2, the isolating device 10 is comprised generally of an adaptor head 12 having an outlet 14 configured to encircle a conventional swimming pool drain 44 and an inlet 16 configured to receive the end 68 of a conventional vacuum hose 64. As best illustrated in FIG. 2, the adaptor head 11 of the preferred embodiment defines a substantially cylindrical configuration having a diameter at least as large as the particular drain 44 with which the isolating device 10 is being used. In the preferred embodiment, a plurality of screw bosses 20 is provided on the interior of the adaptor head 12 proximate the outlet 14 to cooperate with the threaded openings 48 provided in the drain 44 for securing the drain grate (not shown) 46. Thus, the isolating device 10 may be secured to the drain 44 if necessary by diving to the drain 44, removing the drain grate and securing the isolating device 10 in its place. Thus, the diameter of the isolating device 10 is selected as a function of the drain diameter. It will be understood that although a specific geometry of the isolating device 10 has been disclosed, the isolating device 10 geometry may be adapted, whether in size or shape, to conform to any drain 44, whether the drain 44 is associated with a swimming pool 40 as described, or some other fluid reservoir.

The screw bosses 20 defined by the adaptor head 12 are configured to extend the height of the adaptor head in order to assist in facilitating the securement of the isolating device 10 over the drain 44. Fasteners such as the illustrated screws 24 also are configured to extend the height of the adaptor head. The inlet 16 is carried by the end 22 of the adaptor head 12 and is configured to be closely received within one end 68 of a conventional vacuum hose 64. The inlet 16 may be alternatively configured to adapt to other types of vacuum hoses 64. The end 22 may also define a relief valve 26 for pressure equalization within the piping system 42, and especially within the isolating device 10. The illustrated relief valve 26 is defined by a through opening. However, other types of relief valves 26 may be incorporated as well. It will be seen that when the isolating device 10 is in place and the circulating pump 62 is activated, a vacuum within the isolating device 10 causes the adaptor head 12 to pull away from the drain 44, thus breaking the circuit defined by the piping system 42 and hoses 64. Thus, by providing a relief valve 26, the pressure is equalized. Losses due to the relief valve 26 have been found to be negligible. Alternatively, a weight (not shown) may be placed on the adaptor head 12, or the adaptor head 12 may be secured to the drain 44 as described above.

In the preferred embodiment, the adaptor head 12 is fabricated from a transparent material such that one can see within the volume while securing the adaptor head 12 to the drain grate, and during the treatment process if required. Further, in the preferred embodiment, the adaptor head 12 is fabricated in a conventional manner such that at least the cylindrical wall 18 and end member 22 form a one-piece construction.

An attachment member 28 is provided for the attachment of an elongated handle member 30. The attachment member 28 is similar to conventional attachment members carried by conventional vacuum heads (not shown). Therefore, a conventional handle 30 used for vacuuming a swimming pool 40 may be attached to the adaptor head 12 for manipulating the adaptor head 12 to a position over the drain 44. When the isolating device 10 is not secured to the drain 44 as described above, the handle 30 may be used to apply pressure to the adaptor head 12 to maintain its position.

Figure 2A:
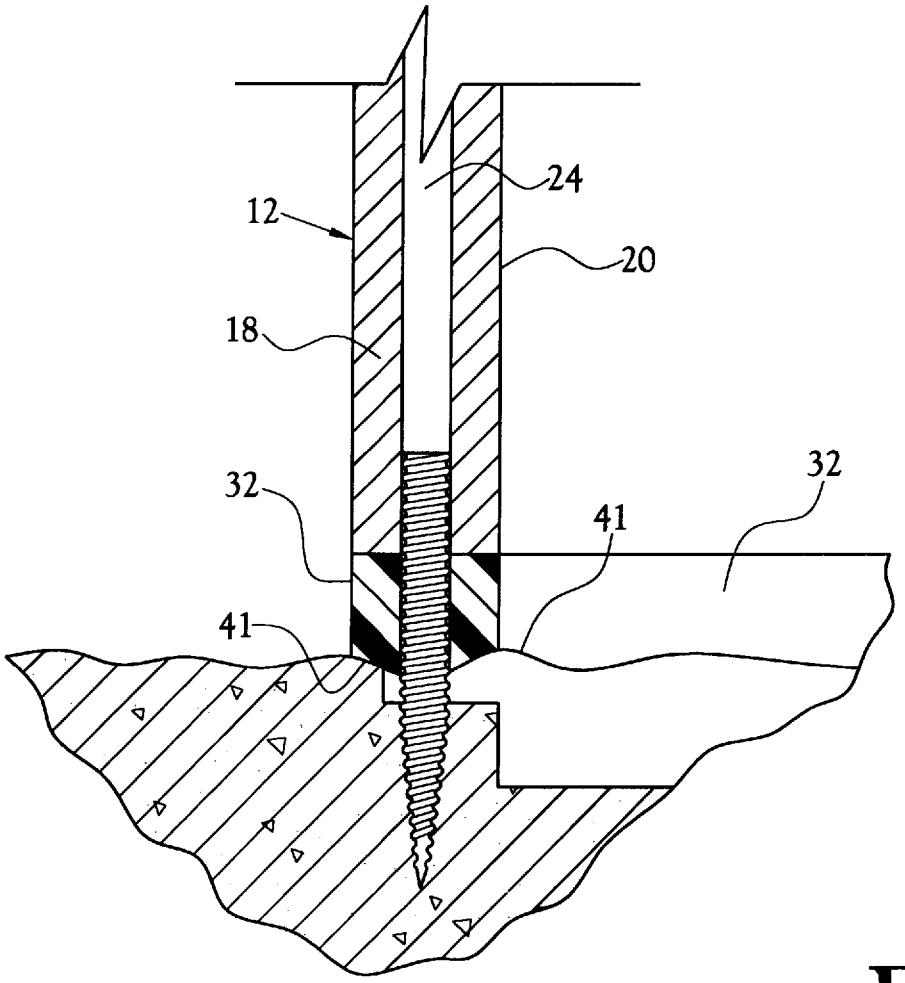
FIG. 2A illustrates an elevation view, in section, of the device for isolating piping associated with a swimming pool taken at 2—2 of FIG. 1, illustrating the device including a gasket for forming a seal between the device and the swimming pool floor.

FIG. 2A illustrates an alternate embodiment of the isolating device 10 wherein a gasket 32 is provided for forming a seal between the isolating device 10 and the floor of the swimming pool 40. The gasket 32 is especially useful in swimming pools 40 where discontinuities 41 are present. Such discontinuities 41 prevent a seal between the floor of the swimming pool 40 and the isolating device 10, thus negating the effects of the isolating device 10 by allowing treated water to escape from within the piping system 42 and into the volume of water in the swimming pool 40. The gasket 32 of the present invention is fabricated from a pliable, water-impermeable material such as rubber in order to allow the gasket 32 to conform to the swimming pool discontinuities 41 and to prevent water from leaking through.

Figure 3:
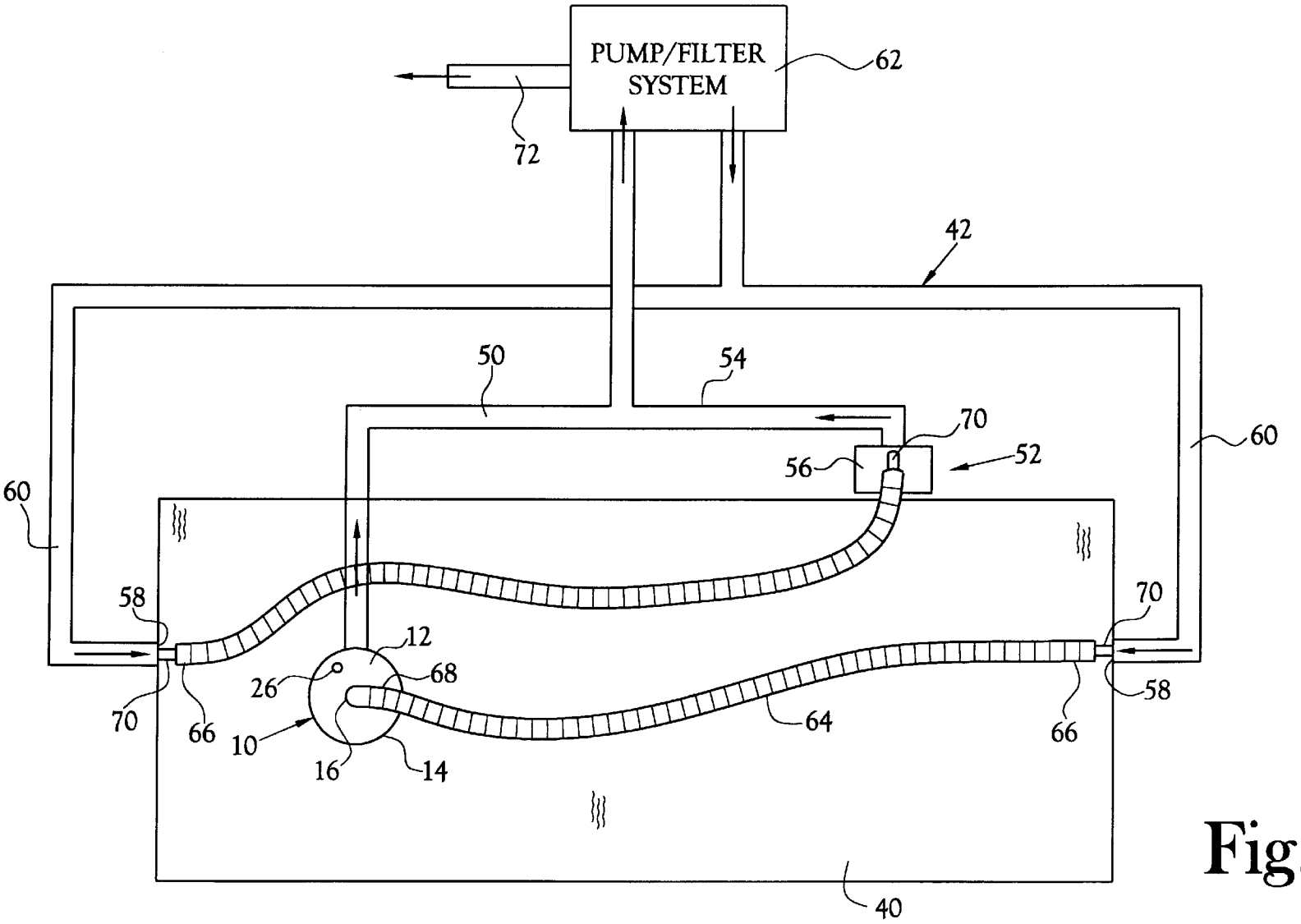
FIG. 3 is a schematic diagram illustrating the device of FIG. 1 being used in the isolation of a swimming pool piping system.

FIG. 3 illustrates a typical swimming pool piping system 42 including a pump and filter (illustrated at 62 for simplicity), two returns 58, a drain 44, and a skimmer 52. Other swimming pools 40 may include more or fewer returns 58, drains 44, and/or skimmers 52. For such pools 40, it will be seen that necessary adaptations can be easily made. Each drain 44 and skimmer 52 is placed in fluid communication with a return 58 such that water flows directly from a return 58 to a drain 44 or skimmer 52. In those situations where there are more returns 58 than drains 44 and skimmers 52, extra returns 58 are either plugged or tied into other returns 58. In a contrary situation, the extra drains 44 and/or skimmers 52 are either plugged or tied together. Thus, in any situation, water is prevented from flowing into or out of the pool 40 and out of or into the piping system 42.

The isolating device 10 may be used in one of several methods. The primary use is for chemically treating the piping system 42. In this instance, the pool pump 62 is first turned OFF, and the conventional flow diverters (not shown) are removed from the returns 58, to facilitate connection of a hose 64. Any skimmer baskets are also removed from their respective skimmer chamber 56. Hose adaptors 70 are then connected to each return 58 and skimmer line 54, with an equal number of adaptors 70 being allotted for the returns 58 as for the combined number of skimmers 52 and drains 44. Any extra returns 58 or skimmer lines 54 are plugged. Hoses 64 are then connected at their first ends 66 to each unplugged return 58. The pump 62 is then turned ON to purge the hoses 64 of any air. While the pump 62 continues to run, the free ends 68 are then connected to each unplugged skimmer 52. Typically, this process requires no more than five minutes.

The isolating device 10 of the present invention is then placed over the drain 44 and secured thereto as desired and as described above. A hose 64 is then connected to the isolating device inlet 16 and the pump 62 is again allowed to run for several minutes to insure that a substantially closed circuit has been established. Once all of the proper connections have been made, a hose 64 at a skimmer 52 is disconnected, and, while the pump 62 is running, the required chemicals are introduced into the skimmer chamber 56. When all of the chemical has been introduced and received into the piping system 42, the hose 64 is reconnected at the skimmer 52. It is typically visually evident when all of the chemical has been received within the piping system 42. When the pump 62 has circulated the treated water within the piping system 42 for the prescribed period of time, the pump 62 is turned OFF and all of the hoses 64 are disconnected from the suction side 68 (skimmers and drains). The free end 68 of each hose 64 is directed away from the pool 40 to an area suitable for the discharge of the chemically treated water. The pump 62 is turned back ON and is allowed to run until the treated water has been discharged from the piping system 42. This procedure is then repeated for any returns 58 or skimmers 52 which were plugged during a previous process.

In an alternate method, each of the returns 58, skimmers 52, and drains 44 may be connected to a manifold (not shown) such that a single iteration of the above method is required to treat every line 50,54,60 within the piping system 42.

To winterize the pool 40, the drain valve (not shown) is closed and the filter valve (not shown) is set to the waste or backwash position. The skimmer valve (not shown) is opened in order to allow the skimmer line 54 to drain out of the waste line 72. A conventional blower (not shown) such as a conventional wet/dry shop vac may be used to assist in emptying the skimmer line 54. When most or all of the water in the skimmer line 54 has been removed, the skimmer valve is closed. The isolating device 10 is then placed over the drain 44 and connected as described above is desired. One end 68 of a hose 64 is attached to the device inlet 16, with the other end 66 being left out of the water and disconnected. The drain valve is then opened such that water in the drain line 50 will drain out of the waste line 72. As before, a blower may be used to assist in the evacuation of water from the drain line 50. Antifreeze may now be introduced into the drain line 50 through the hose 64 attached to the isolating device 10. The drain valve is once again closed. The isolating device 10 is then removed, and the drain grate replaced if necessary.

From the foregoing description, it will be recognized by those skilled in the art that a device for isolating piping associated with a swimming pool offering advantages over the prior art has been provided. Specifically, the isolating device provides a means for isolating the piping system associated with a swimming pool such that the piping system may be chemically treated, or winterized without substantially effecting the water within the swimming pool. It will be recognized, as indicated above that the present invention may be adapted for use with other liquid reservoirs having associated piping systems between at least one inlet and at least one outlet, thereby allowing treatment of fluid within the piping system exclusive of the fluid within the reservoir.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention, I claim:

1. A device for isolating a piping system associated with a swimming pool, the piping system including at least one drain and associated drain line, at least one skimmer and associated skimmer line, and at least one return and associated return line, said device comprising:

an adapter head adapted to isolate the piping system of the swimming pool from water within the swimming pool, said adaptor head defining an inlet adapted to be closely received within one end of a conventional vacuum hose and an outlet configured to encircle the drain, said adaptor head including a substantially cylindrical side wall and an end wall carried at a first end of said side wall, said inlet being carried by said end wall, and said outlet being defined at a second end of said side wall.

2. The device of claim 1 wherein said adaptor head further includes a plurality of receptors for securement of said adaptor head to the drain after removal of a conventional drain grate therefrom.

3. The device of claim 1 further comprising a relief valve carried by said adaptor head end wall.

4. The device of claim 3 wherein said relief valve includes a through opening defined by said end wall.

5. The device of claim 1 further comprising an attachment device carried by said end wall for securement of a conventional handle used to manipulate said device along the bottom of the pool.

6. The device of claim 1 further comprising a gasket carried by said second end of said side wall proximate said outlet, said gasket being provided for accomplishing a seal between said device and the swimming pool.

7. A device for isolating a piping system associated with a swimming pool, the piping system including at least one drain and associated drain line, at least one skimmer and associated skimmer line, and at least one return and associated return line, said device comprising:

an adapter head adapted to isolate the piping system of the swimming pool from water within the swimming pool, said adaptor head defining an inlet adapted to be closely received within one end of a conventional vacuum hose and an outlet configured to encircle the drain, said adaptor head including a substantially cylindrical side wall and an end wall mounted to said side wall at a first end thereof, said inlet being carried by said end wall, and said outlet being defined at a second end of said side wall;

a plurality of receptors carried by said side wall for securement of said adaptor head to the drain after removal of a conventional drain grate therefrom;

a relief valve carried by said adaptor head end wall including a through opening defined by said end wall; and an attachment device carried by said end wall for securement of a conventional handle used to manipulate said device along the bottom of the pool.

8. The device of claim 7 further comprising a gasket carried by said second end of said side wall proximate said outlet, said gasket being provided for accomplishing a seal between said device and the swimming pool.

9. A method for isolating and treating a piping system associated with a swimming pool, the piping system including at least one drain and associated drain line, at least one skimmer and associated skimmer line, and at least one return and associated return line, each of the at least one skimmer being provided with a skimmer basket, each of the at least one return line being provided with a conventional flow diverter, said method comprising the steps of:

(A) turning off a pump associated with the piping system;

(B) removing the flow diverter from each of the at least one return;

(C) removing each skimmer basket from each of the at least one skimmer;

(D) installing one of a plurality of hose adaptors on each of the at least one return and on each of the at least one skimmer;

(E) connecting one of at least one hose at a first end to each hose adaptor mounted on each of the at lease one return, leaving the second end of each of the at least one hose free;

(F) turning on the pump for a period sufficient to purge air from within each of the at least one hose;

(G) placing an isolating device above the drain, said isolating device including an adapter head defining an inlet adapted to be closely received within one end of a hose and an outlet configured to encircle the drain, said adaptor head including a substantially cylindrical side wall and an end wall carried at a first end of said side wall, said inlet being carried by said end wall, and said outlet being defined at a second end of said side wall;

(H) connecting the second end of one of the at least one hose to said adaptor head inlet;

(I) connecting the second end of each remaining at least one hose to a hose adaptor mounted in each of the at least one skimmer to form at least one return/skimmer pair;

(J) plugging any return and any skimmer remaining unpaired with a skimmer and a return, respectively, after said steps of connecting the at least one hose to the at least one return, said adaptor head inlet, and the at least one skimmer;

(K) turning on the pump to insure the piping system has been isolated;

(L) removing a hose second end from one of the at least one skimmer and placing the hose second end into the swimming pool;

(M) applying required chemicals into the one of the at least one skimmer;

(N) replacing the hose second end into the one of the at least one skimmer after the chemicals have been received into the skimmer line;

(O) turning the pump off after a specified treatment time;

(P) disconnecting each of the at least one hose second end from each of the at least one skimmer and said adaptor head inlet and placing each of the at least one hose second end at a location directed away from the swimming pool;

(Q) turning on the pump for a period of time to evacuate treated water from each of the at least one hose and piping system;

(R) removing each of the at least one hose from each of the at least one return, and the plurality of hose adaptors from each of the at least one skimmer and each of the at least one return;

(S) repeating steps (D) through (H) and (J) through (R) for any remaining untreated return lines, skimmer lines, and drain lines; and (T) removing said adaptor head.

10. The method of claim 9, immediately after said step (F), further comprising the step of removing the drain gate, and immediately after said step (G) further comprising the step of mounting said adaptor head to said drain, said adaptor head further comprising a plurality of receptors for securement of said adaptor head to the drain after removal of a conventional drain gate therefrom.

* * * * *